US009779928B2

(12) United States Patent
Manabe

(10) Patent No.: US 9,779,928 B2
(45) Date of Patent: Oct. 3, 2017

(54) VACUUM PUMP AND MASS SPECTROMETER

(71) Applicant: Shimadzu Corporation, Kyoto (JP)

(72) Inventor: Masashi Manabe, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 15/145,895

(22) Filed: May 4, 2016

(65) Prior Publication Data

US 2016/0365234 A1 Dec. 15, 2016

(30) Foreign Application Priority Data

Jun. 9, 2015 (JP) ..... 2015-116589

(51) Int. Cl.

| | |
|---|---|
| ***H01J 49/24*** | (2006.01) |
| ***F04D 25/16*** | (2006.01) |
| ***F04D 17/16*** | (2006.01) |
| ***F04D 19/04*** | (2006.01) |

(52) U.S. Cl.

CPC ..... *H01J 49/24* (2013.01); *F04D 17/168* (2013.01); *F04D 19/044* (2013.01); *F04D 19/046* (2013.01)

(58) Field of Classification Search

CPC ..... H01J 49/24; F04D 17/168; F04D 19/044; F04D 19/046

USPC ..... 250/281, 282, 283

See application file for complete search history.

(56) References Cited

U.S. PATENT DOCUMENTS

| | | | | |
|---|---|---|---|---|
| 7,866,940 | B2 | 1/2011 | Stones et al. | |
| 8,672,607 | B2 | 3/2014 | Stones et al. | |
| 8,851,865 | B2 | 10/2014 | Stones et al. | |
| 9,249,805 | B2 | 2/2016 | Stones et al. | |
| 2008/0063541 | A1* | 3/2008 | Stones | F04D 19/04 417/250 |

FOREIGN PATENT DOCUMENTS

| | | |
|---|---|---|
| JP | 2005-030209 A | 2/2005 |
| JP | 2014-001743 A | 1/2014 |

* cited by examiner

*Primary Examiner* — Nicole Ippolito

(74) *Attorney, Agent, or Firm* — Renner Otto Boisselle & Sklar, LLP

(57) ABSTRACT

A vacuum pump comprises: a first pump stage; a second pump stage provided downstream of the first pump stage; a first suction port provided on a suction side of the first pump stage; and a second suction port provided downstream of the first pump stage and communicating with the second pump stage. The first pump stage includes a siegbahn pump portion suitable for a small exhaust volume, and a turbomolecular pump portion. The second pump stage includes a Holweck pump portion suitable for a great exhaust volume.

3 Claims, 5 Drawing Sheets

VACUUM PUMP AND MASS SPECTROMETER

BACKGROUND OF THE INVENTION

1. Technical Field

The present invention relates to a vacuum pump and a mass spectrometer.

2. Background Art

In a mass spectrometer, a working pressure region varies among a plurality of analysis units. A vacuum pump formed with a plurality of suction ports has been known as a vacuum pump for such a mass spectrometer (see, e.g., Patent Literature 1 [JP-A-2014-1743]).

The vacuum pump described in Patent Literature 1 includes three pump stages. A first suction port is provided on a suction side of the first pump stage, a second suction port is provided between the first and second pump stages, and a third suction port is provided between the second and third pump stages.

In the vacuum pump formed with the suction ports, the first pump stage exhausts the gas having entered through the first suction port, and the second pump stage exhausts the gas having exhausted from the first pump stage and the gas having entered through the second suction port. Similarly, the third pump stage exhausts the gas having exhausted from the second pump stage and the gas having entered through the third suction port. For example, the volume of gas exhausted from the third pump stage is several to some dozen times as much as the volume of gas exhausted from the second pump stage.

Thus, in the case of the vacuum pump formed with the suction ports, each pump stage needs to be configured suitable for a suction pressure and exhaust volume required for respective pump stage.

SUMMARY OF THE INVENTION

A vacuum pump comprises: a first pump stage; a second pump stage provided downstream of the first pump stage; a first suction port provided on a suction side of the first pump stage; and a second suction port provided downstream of the first pump stage and communicating with the second pump stage. The first pump stage includes a siegbahn pump portion suitable for a small exhaust volume, and a turbo-molecular pump portion, and the second pump stage includes a Holweck pump portion suitable for a great exhaust volume.

The second suction port is provided between an upstream end portion and a downstream end portion in an exhaust path of the second pump stage.

Amass spectrometer comprises: the vacuum pump; a first analysis unit; a second analysis unit configured to operate in a pressure region higher than a pressure region of the first analysis unit; a first chamber configured to house the first analysis unit and provided with a first exhaust port connected to the first suction port of the vacuum pump; and a second chamber configured to house the second analysis unit and provided with a second exhaust port connected to the second suction port of the vacuum pump.

According to the present invention, the exhaust performance of the vacuum pump formed with the suction ports can be improved.

DETAILED DESCRIPTION OF THE EXEMPLARY EMBODIMENTS

Figure 1:
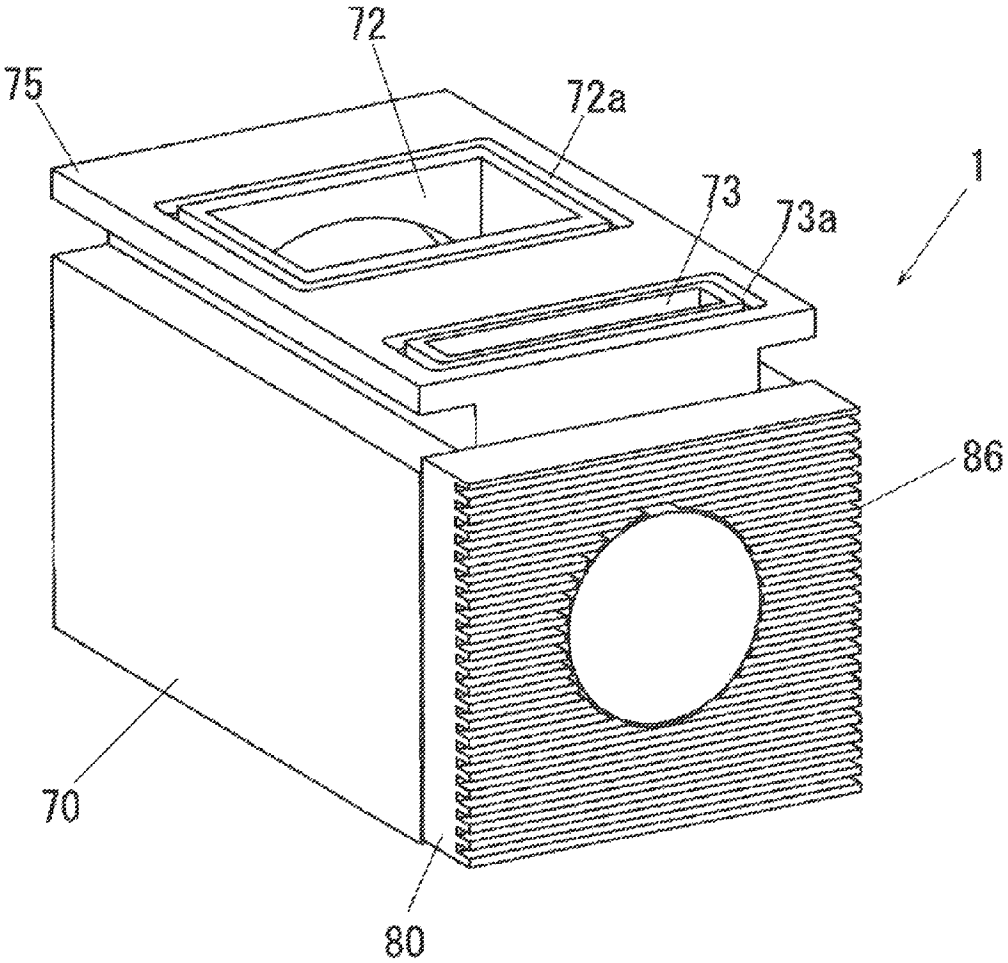
FIG. 1 is a perspective view of an outer appearance of a vacuum pump of an embodiment of the present invention.

Embodiments of the present invention will be described below with reference to drawings. FIG. 1 is a perspective view of an outer appearance of a vacuum pump of an embodiment of the present invention. A vacuum pump 1 includes a first housing 70 and a second housing 80. A flange portion 75 formed with a first suction port 72 and a second suction port 73 is provided at the first housing 70. The suction ports 72, 73 are formed respectively with seal ring grooves 72*a*, 73*a*, a seal ring being attached to each of the seal ring grooves 72*a*, 73*a*. A motor is, as described later, provided at the second housing 80, and radiator fins 86 are provided on the surface of the second housing 80 (i.e., the bottom surface of the vacuum pump 1).

Figure 2:
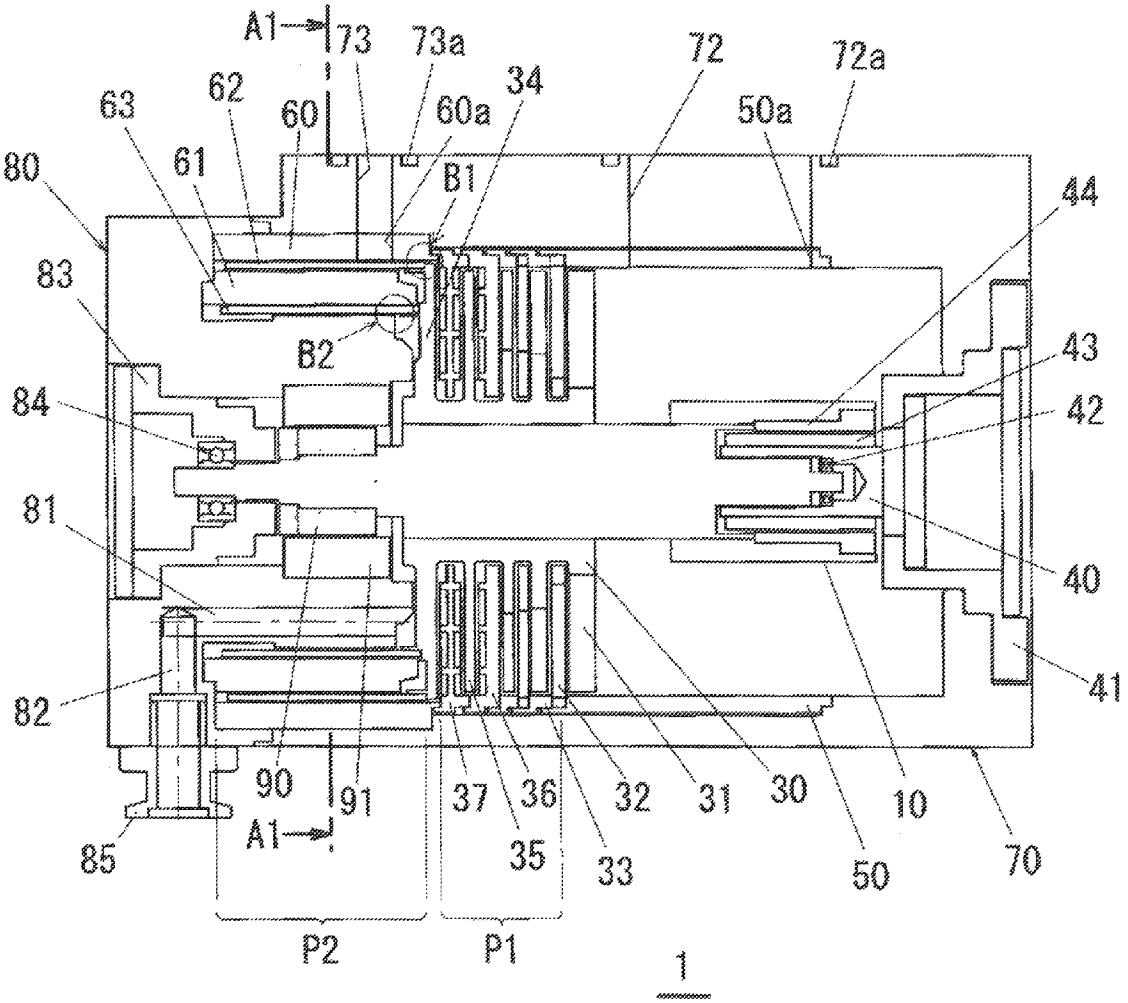
FIG. 2 is a cross-sectional view of the vacuum pump.
Figure 3:
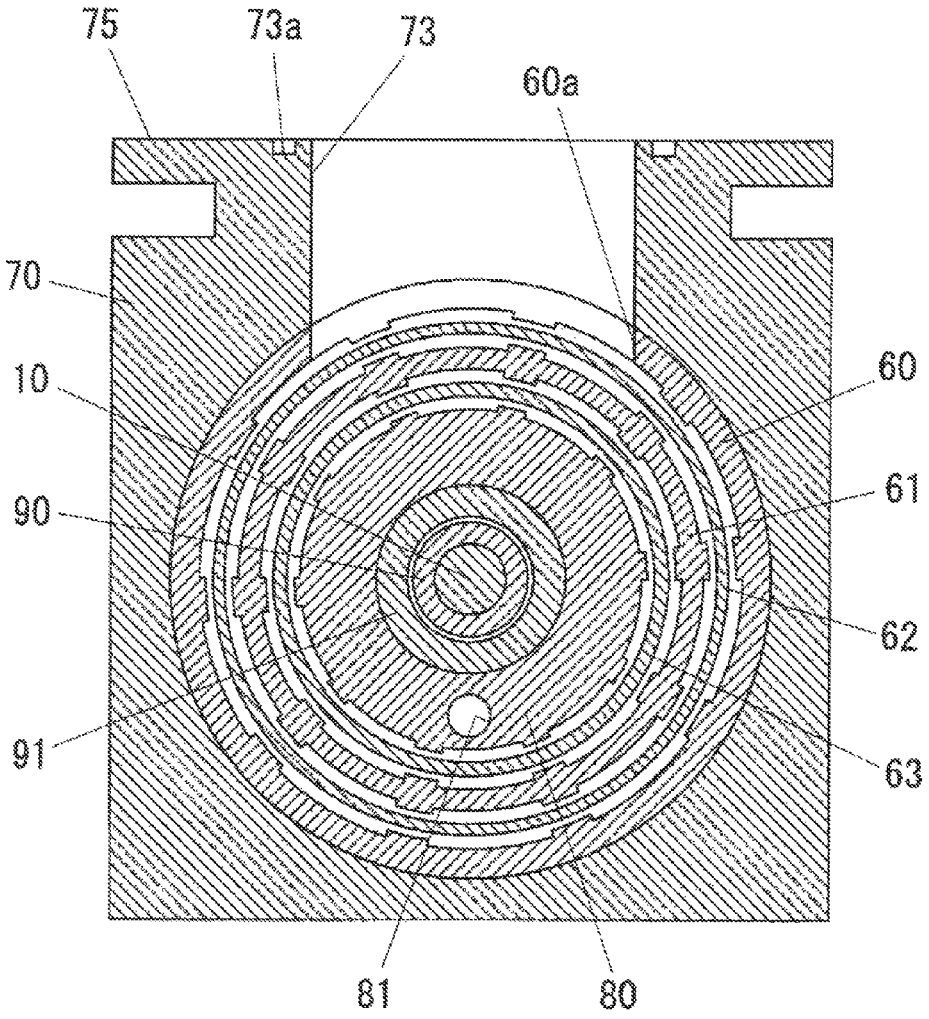
FIG. 3 is a cross-sectional view along an A1-A1 line of FIG. 2.

FIG. 2 is a cross-sectional view of the vacuum pump 1 in the axial direction thereof. Moreover, FIG. 3 is a cross-sectional view along an A1-A1 line of FIG. 2. A shaft 10 to which a pump rotor 30 and a motor rotor 90 are fixed is provided inside the first housing 70. The shaft 10 is supported by a magnetic bearing using permanent magnets 43, 44 and a ball bearing 84. A motor stator 91 provided on the outer peripheral side of the motor rotor 90 is held by the second housing 80. The ball bearing 84 is held by a bearing holder 83 fixed to the second housing 80.

The permanent magnet 44 is fixed in a recess formed at a right end portion of the shaft 10 as viewed in the figure. The permanent magnet 43 disposed inside the permanent magnet 44 is held by a magnet holder 40. The magnet holder 40 is fixed to a holder support 41, and the holder support 41 is fixed to the first housing 70. A ball bearing 42 is provided at the magnet holder 40. The ball bearing 42 functions as a restriction member configured to restrict whirling of the shaft 10 such that the permanent magnet 44 and the permanent magnet 43 do not contact each other.

The vacuum pump 1 includes a first pump stage P1 and a second pump stage P2. The first pump stage P1 includes a turbo-molecular pump portion having a plurality of rotor blade stages 31 and a plurality of stationary blade stages 32, and a siegbahn pump portion having a rotary plate 35 and fixed thread groove plates 36, 37. Thread grooves (spiral grooves) extending in the radial direction are formed at the following surfaces: the surface of the fixed thread groove plate 36 facing the rotary plate 35; and both of the front and back surfaces of the fixed thread groove plate 37.

Each of the rotor blade stages 31 and the stationary blade stages 32 includes a plurality of turbine blades. The rotor blade stages 31 and the rotary plate 35 are provided at the pump rotor 30. The position of each stationary blade stage 32 in the axial direction thereof (the right-left direction as viewed in the figure) is determined by spacers 33, 50.

The second pump stage P2 includes a first cylindrical rotor 62, a second cylindrical rotor 63, a first screw stator 60, and a second screw stator 61. The second pump stage P2 forms a Holweck pump. The first cylindrical rotor 62 and the second cylindrical rotor 63 are fixed to a discoid portion 34 provided at the right end of the pump rotor 30 as viewed in the figure. The first screw stator 60 is provided on the outer peripheral side of the first cylindrical rotor 62. The second screw stator 61 is provided between the first cylindrical rotor 62 and the second cylindrical rotor 63. At each of the first and second screw stators 60, 61 of the Holweck pump, a thread groove (a spiral groove) extending in the axial direction is formed. A through-hole 60*a* is formed at the position of the first screw stator 60 facing a third suction port 173 of the first housing 70.

As illustrated in FIG. 3, thread grooves and threads are formed at the following surfaces: the inner peripheral surface of the first screw stator 60; the outer and inner peripheral surfaces of the second screw stator 61; and the surface of the second housing 80 facing the inner peripheral surface of the second cylindrical rotor 63.

The gas having entered through the first suction port 72 illustrated in FIG. 2 is, by the first pump stage P1, exhausted to the downstream side of the first pump stage P1, i.e., the suction side of the second pump stage P2. The gas having exhausted by the first pump stage P1 and the gas having entered through the second suction port 73 are exhausted by the second pump stage as the Holweck pump. The gas having exhausted by the second pump stage passes through exhaust paths 81, 82 formed at the second housing 80, and then, is exhausted through an exhaust port 85.

As described above, the first pump stage P1 and the second pump stage P2 are different from each other in the volume of exhausted gas. In general, the pressure P(73) at the second suction port 73 is equal to or higher than ten times as high as the pressure P(72) of the first suction port 72, and the volume of gas exhausted by the second pump stage is several to some dozen times as much as the volume of gas exhausted by the first pump stage. In the case of the pump stages being different from each other in the exhaust volume as described above, settings of respective pump stages are preferably optimized depending on the exhaust volume. In the case of using the vacuum pump 1 for an analysis device such as a mass spectrometer, connection of the first suction port 72 to a relatively-high-vacuum chamber should be taken into consideration.

In the present embodiment, the Holweck pump suitable for a great exhaust volume is used as the second pump stage P2 requiring a great exhaust volume. Moreover, the first pump stage P1 for a small exhaust volume is configured as a pump stage suitable for a small exhaust volume in such a manner that the turbo-molecular pump portion and the siegbahn pump portion are combined together. Although the siegbahn pump and the Holweck pump are both thread groove-type pumps, the Holweck pump formed with the thread grooves extending in the axial direction is suitable for exhaust of a great volume of gas, and the siegbahn pump formed with the thread grooves extending in the radial direction is suitable for exhaust of a small volume of gas. For this reason, in the present embodiment, the siegbahn pump portion is provided at the first pump stage P1 for a small exhaust volume, and the Holweck pump portion is used for the second pump stage P2 for a great exhaust volume.

In order to satisfy a high-vacuum (low-pressure) requirement for the pressure at the first suction port, the turbo-molecular pump portion suitable for high-vacuum exhaust is provided in addition to the siegbahn pump portion suitable for exhaust of a small volume of gas. As a result, the first pump stage P1 is configured as a pump stage for a small exhaust volume and a high vacuum (a high compression ratio) . Note that the design parameters of the thread groove of the siegbahn pump stage include, e.g., a groove angle, a groove depth, a groove width, and the number of grooves. These design parameters are set at the values suitable for a small exhaust volume, and therefore, the siegbahn pump stage for a small exhaust volume can be configured.

For example, when the first pump stage P1 providing the above-described performance includes only a turbo pump, the number of rotor blade stages and stationary blade stages needs to be increased. For this reason, the dimensions of the first pump stage P1 in the axial direction thereof are greater than those in the case of the combination of the siegbahn pump portion and the turbo-molecular pump portion.

JP-A-2005-30209 discloses, as a vacuum pump formed with two suction ports, a vacuum pump including a turbo-molecular pump portion, a siegbahn pump portion, and a Holweck pump portion. However, the vacuum pump of JP-A-2005-30209 relates to the technical idea of dividing a thread groove pump into two sections and providing a second suction port at one of the divided sections, and a new first pump stage is configured in such a manner that the siegbahn pump as a thread groove pump is added to the turbo-molecular pump portion as an original first pump stage. With this configuration, the pressure at the second suction port is increased, but the dimensions of the first pump stage in the axial direction thereof are increased by the additional siegbahn pump.

On the other hand, the first pump stage P1 of the present embodiment is not configured in such a manner that the thread groove pump is simply added to the turbo-molecular pump portion functioning as in the first pump stage of the conventional case. That is, the first pump stage P1 of the vacuum pump 1 is configured in such a manner that the siegbahn pump portion suitable for a small exhaust volume and the turbo-molecular pump portion are combined together to satisfy the requirement for exhaust of a small volume of gas from the first pump stage P1 and the pressure requirement for the first suction port 72. Thus, while these requirements can be satisfied, the dimensions of the first pump stage P1 in the axial direction thereof can be smaller.

(Description on Through-Hole 60*a*) In the present embodiment, the gas having entered through the second suction port 73 is, through the through-hole 60*a* of the first screw stator 60, introduced between an upstream end portion and a downstream end portion in an exhaust path of the second pump stage P2, as illustrated in FIG. 2. The upstream end portion in the exhaust path of the second pump stage P2 is the portion indicated by a reference numeral "B1" in FIG. 2. Moreover, the downstream end portion is the portion indicated by a reference numeral "B2" in FIG. 2.

The gas having entered through the through-hole 60*a* flows into the clearance between the first screw stator 60 and the first cylindrical rotor 62, and then, is exhausted toward the downstream side (the left side as viewed in FIG. 2) by pumping action. The through-hole 60*a* is connected to the middle of the exhaust path of the second pump stage P2. This can prevent the gas having entered through the through-hole 60*a* from flowing back to the upstream side of such a connection position. As a result, an increase in the pressure of the first suction port 72 due to backflow can be prevented.

On the other hand, in, e.g., the vacuum pump described in JP-A-2005-30209, the second suction port is provided between the first and second pump stages. That is, the configuration is employed, in which the gas having entered through the second suction port and the gas having exhausted by the siegbahn pump portion join together, and then, are exhausted by the Holweck pump portion. Thus, backflow toward the first pump stage is more noticeable as compared to the present embodiment, and due to such backflow, the pressure at the first suction port might increase.

(Variation)

Figure 4:
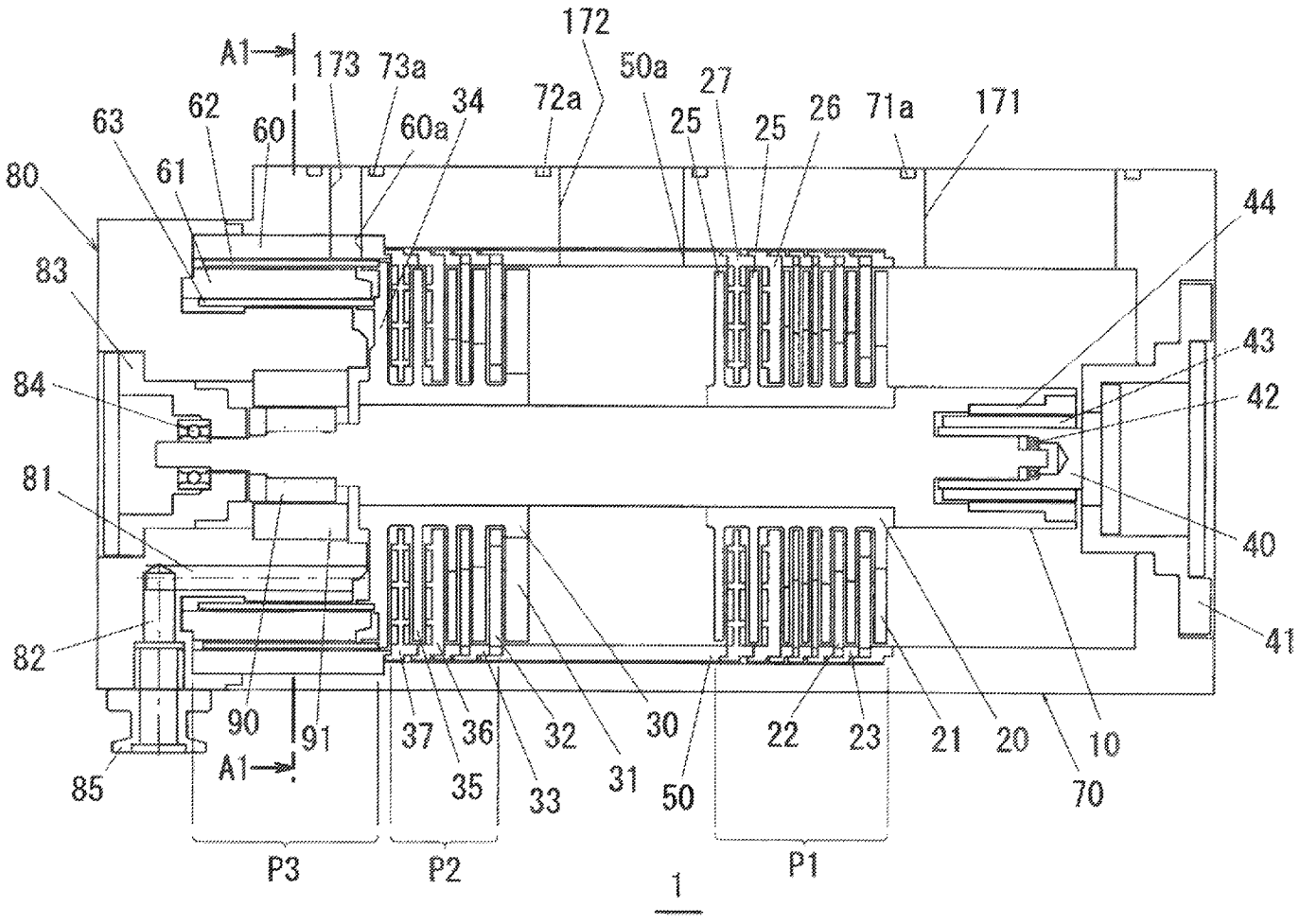
FIG. 4 is a view of an example of a vacuum pump including three pump stages.

FIG. 4 is a view of an example of a vacuum pump 1 including three pump stages. The vacuum pump 1 illustrated in FIG. 4 includes a first pump stage P1, a second pump stage P2, and a third pump stage P3. A first suction port 171, a second suction port 172, and a third suction port 173 are formed corresponding to the pump stages P1 to P3 at a first housing 70. Note that the vacuum pump 1 of FIG. 4 is configured such that an additional pump stage is provided upstream of the first pump stage P1 of the vacuum pump 1 of FIG. 2. That is, the second pump stage P2 corresponds to the first pump stage P1 illustrated in FIG. 2, and the third pump stage P3 corresponds to the second pump stage P2 illustrated in FIG. 2. Note that the second and third pump stages P2, P3 have the configurations similar to those of the first and second pump stages P1, P2 illustrated in FIG. 2, and for this reason, description thereof will not be repeated.

In the variation, the idea of the first pump stage P1 illustrated in FIG. 2 is applied to the first and second pump stages P1, P2 of FIG. 4. The first pump stage P1 includes rotor blade stages 21 and stationary blade stages 22 as a turbo-molecular pump portion, and further includes a rotary plate 25 and fixed thread groove plates 26, 27 as a siegbahn pump stage. The rotor blade stages 21 and the rotary plate 25 are formed at a pump rotor 20 fixed to a shaft 10.

The gas having entered through the first suction port 171 is exhausted toward the downstream side of the first pump stage P1 by the first pump stage P1. The gas having entered through the second suction port 172 and the gas having exhausted by the first pump stage P1 are exhausted toward the downstream side of the second pump stage P2 by the second pump stage P2. The gas having exhausted by the second pump stage P2 and the gas having entered through the third suction port 173 are exhausted by the third pump stage P3. The gas having exhausted by the third pump stage P3 passes through exhaust paths 81, 82 formed at a second housing 80, and then, is discharged through an exhaust port 85. The pressure P increases toward the downstream side in the order of the suction ports 171, 172, 173, i.e., P(171)<P(172)<P(173).

As described above, the first pump stage P1 of FIG. 4 is the combination of the turbo-molecular pump portion and the siegbahn pump portion as in the second pump stage P2 provided downstream of the first pump stage P1 of FIG. 4. In the case of the vacuum pump 1 illustrated in FIG. 4, the volume of exhaust from the first pump stage P1 is much less than the volume of exhaust from the second pump stage P2. Moreover, the pressure at the first suction port 171 is lower than the pressure at the second suction port 172. Thus, the siegbahn pump portion of the first pump stage P1 is more optimized for a small exhaust volume as compared to the siegbahn pump portion of the second pump stage P2. Moreover, in order to satisfy the pressure requirement for the first suction port 171, the turbo-molecular pump portion of the first pump stage P1 is in the blade shape more optimized as a high-vacuum type as compared to the turbo-molecular pump portion of the second pump stage P2.

(Mass Spectrometer)

Figure 5:
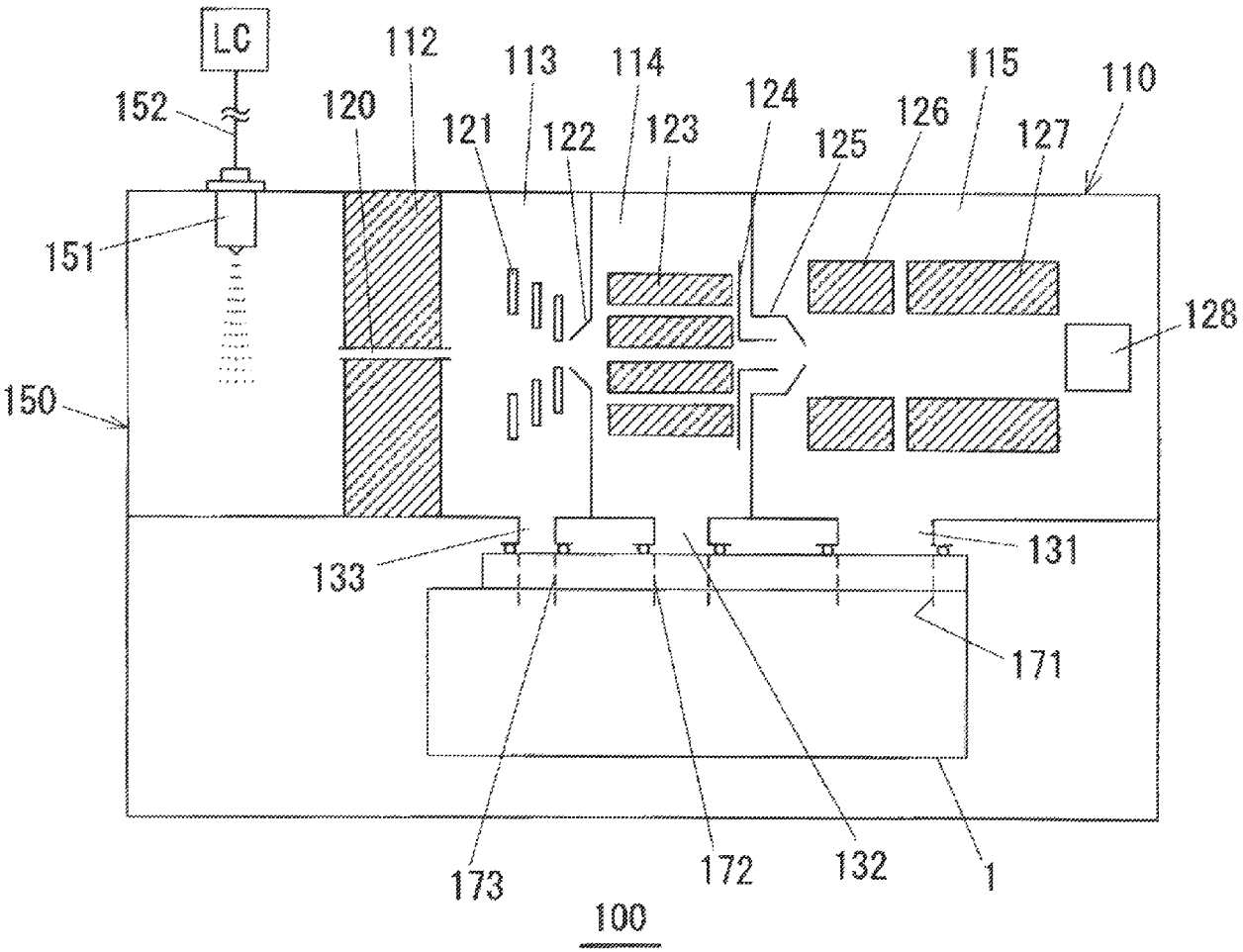
FIG. 5 is a view of an example of a mass spectrometer.

FIG. 5 is a view of an example of a mass spectrometer 100 including a vacuum pump formed with a plurality of suction ports. The mass spectrometer 100 includes three vacuum chambers, and the vacuum pump 1 including three suction ports 171 to 173 illustrated in FIG. 4 is applied to the mass spectrometer 100. FIG. 5 illustrates an outline configuration of a liquid chromatograph-mass spectrometer using electrospray ionization (ESI).

The mass spectrometer 100 includes an ionization chamber 150 and a mass analyzer 110. Partitioning walls form the following chambers in the mass analyzer 110: a first intermediate chamber 113 adjacent to the ionization chamber 150; a second intermediate chamber 114 adjacent to the first intermediate chamber; and an analysis chamber 115 adjacent to the second intermediate chamber 114.

The first suction port 171 of the vacuum pump 1 is connected to an exhaust port 131 of the analysis chamber 115. The second suction port 172 of the vacuum pump 1 is connected to an exhaust port 132 of the second intermediate chamber 114. The third suction port 173 of the vacuum pump 1 is connected to an exhaust port 133 of the first intermediate chamber 113. As described above, exhaust from three spaces (the first intermediate chamber 113, the second intermediate chamber 114, and the analysis chamber 115) different from each other in a pressure region is performed using the single vacuum pump 1.

An ionization spray 151 is provided in the ionization chamber 150. A liquid sample subjected to component separation by a liquid chromatography portion LC is supplied to the ionization spray 151 through a pipe 152. Although not shown in the figure, nebulizer gas is supplied to the ionization spray 151, and the liquid sample is sprayed from the ionization spray 151. High voltage is applied to a tip end of the ionization spray 151, and ionization is performed in sample spraying. A heater block 112 is provided between the first intermediate chamber 113 and the ionization chamber 150. A desolvation pipe 120 allowing communication between the ionization chamber 150 and the first intermediate chamber 113 is provided in the heater block 112. The desolvation pipe 120 has the function of accelerating desolvation and ionization when the ions generated by the ionization chamber 150 and the liquid drops of the sample pass through the desolvation pipe 120.

A first ion lens 121 is provided in the first intermediate chamber 113. An octopole 123 and a focus lens 124 are provided in the second intermediate chamber 114. An entrance lens 125 formed with a fine pore is provided at the partitioning wall provided between the second intermediate chamber 114 and the analysis chamber 115. A first quadrupole rod 126, a second quadrupole rod 127, and a detector 128 are provided in the analysis chamber 115.

The ions generated by the ionization chamber 150 are sent to the analysis chamber 115 after passing through the desolvation pipe 120, the first ion lens 121 of the first intermediate chamber 113, a skimmer 122, the octopole 123 of the second intermediate chamber 114, the focus lens 124 of the second intermediate chamber 114, and the entrance lens 125 in this order. Then, unnecessary ion is discharged by the quadrupole rods 126, 127, and only particular ion having reached the detector 128 is detected.

As described above, the vacuum pump 1 includes, as illustrated in FIG. 2, the first pump stage P1, the second pump stage P2 provided downstream of the first pump stage P1, the first suction port 72 provided on the suction side of the first pump stage P1, and the second suction port 73 provided downstream of the first pump stage P1 and communicating with the second pump stage P2. The first pump stage P1 includes the siegbahn pump portion (35 to 37) suitable for a small exhaust volume, and the turbo-molecular pump portion (31, 32). The second pump stage P2 includes the Holweck pump portion (60 to 63) suitable for a great exhaust volume.

The first pump stage P1 includes the siegbahn pump portion (35 to 37) suitable for a small exhaust volume, and the turbo-molecular pump portion (31, 32). Thus, an actual use condition, i.e., a small exhaust volume, can be fully satisfied, and the pressure at the first suction port 72 can be held at a required low pressure (a required high vacuum). Moreover, in order to satisfy the requirements for a small exhaust volume and a high vacuum, the turbo-molecular pump portion and the siegbahn pump stage suitable for a small exhaust volume are combined together. Thus, the dimensions of the first pump stage P1 in the axial direction thereof can be more decreased as compared to the conventional case.

Various embodiments and variations have been described above, but the present invention is not limited to the contents of these embodiments and variations. The present invention includes other forms within the scope of the technical idea of the present invention.

What is claimed is:

1. A vacuum pump comprising:

a first pump stage;

a second pump stage provided downstream of the first pump stage;

a first suction port provided on a suction side of the first pump stage; and a second suction port provided downstream of the first pump stage and communicating with the second pump stage, wherein the first pump stage includes a siegbahn pump portion suitable for a small exhaust volume, and a turbo-molecular pump portion, and the second pump stage includes a Holweck pump portion suitable for a great exhaust volume.

2. The vacuum pump according to claim 1, wherein the second suction port is provided between an upstream end portion and a downstream end portion in an exhaust path of the second pump stage.

3. A mass spectrometer comprising:

the vacuum pump according to claim 1;

a first analysis unit;

a second analysis unit configured to operate in a pressure region higher than a pressure region of the first analysis unit;

a first chamber configured to house the first analysis unit and provided with a first exhaust port connected to the first suction port of the vacuum pump; and a second chamber configured to house the second analysis unit and provided with a second exhaust port connected to the second suction port of the vacuum pump.

* * * * *